US008669710B2

(12) United States Patent
Yu et al.

(10) Patent No.: US 8,669,710 B2
(45) Date of Patent: Mar. 11, 2014

(54) LED MODULE AND LED LIGHT STRING USING THE SAME

(75) Inventors: Gang Yu, Shenzhen (CN); Dongsheng Guo, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 297 days.

(21) Appl. No.: 13/143,131

(22) PCT Filed: Apr. 26, 2011

(86) PCT No.: PCT/CN2011/073343

§ 371 (c)(1), (2), (4) Date: Jul. 1, 2011

(87) PCT Pub. No.: WO2012/139310

PCT Pub. Date: Oct. 18, 2012

(65) Prior Publication Data

US 2012/0274212 A1 Nov. 1, 2012

(30) Foreign Application Priority Data

Apr. 14, 2011 (CN) ..... 2011 1 0094083

(51) Int. Cl.
*H05B 37/00* (2006.01)

(52) U.S. Cl.
USPC ..... 315/186; 315/193; 315/209 R; 315/291; 315/312

(58) Field of Classification Search
USPC ..... 315/89–93, 312–325, 185 R, 186, 193, 315/209 R, 291, 189
See application file for complete search history.

(56) References Cited

U.S. PATENT DOCUMENTS

| | | | | |
|---|---|---|---|---|
| 6,194,839 | B1 * | 2/2001 | Chang | 315/185 S |
| 6,344,716 | B1 * | 2/2002 | Gibboney, Jr. | 315/185 S |
| 6,786,625 | B2 * | 9/2004 | Wesson | 362/545 |
| RE43,890 | E * | 1/2013 | Li et al. | 315/185 S |
| 2006/0279262 | A1 | 12/2006 | Chiang et al. | |
| 2008/0074872 | A1 * | 3/2008 | Panotopoulos | 362/231 |
| 2010/0277077 | A1 * | 11/2010 | Pong et al. | 315/152 |

FOREIGN PATENT DOCUMENTS

| | | | |
|---|---|---|---|
| CN | 1057153 | A | 12/1991 |
| CN | 2120419 | U | 10/1992 |
| CN | 1865762 | A * | 11/2006 |
| CN | 1897778 | A | 1/2007 |
| CN | 101193476 | A | 6/2008 |
| CN | 201149953 | Y | 11/2008 |
| CN | 201167423 | Y | 12/2008 |
| CN | 201636622 | U | 11/2010 |
| CN | 201715366 | U | 1/2011 |
| DE | 3306359 | A1 | 8/1984 |
| KR | 20080006379 | A | 1/2008 |

* cited by examiner

*Primary Examiner* — Jason M Crawford
(74) *Attorney, Agent, or Firm* — Sughrue Mion, PLLC

(57) ABSTRACT

The present invention provides an LED module and an LED light string using the same. The LED module has an input terminal, an output terminal, a primary LED, a spare LED and a switching module. The switching module controls the spare LED to be switched off while the primary LED is switched on; and controls the spare LED to be switched on while the primary LED is burned out. Hence, the present invention extends a service life of the LED light string using the LED modules in the backlight module.

11 Claims, 2 Drawing Sheets

LED MODULE AND LED LIGHT STRING USING THE SAME

FIELD OF THE INVENTION

The present invention relates to an LED module, and more particularly to an LED module that provides a reliable light source and an LED light string using the LED modules.

BACKGROUND OF THE INVENTION

Presently light sources of a backlight module are mainly sorted into light emitting diodes (LEDs) and cold cathode fluorescent lamps (CCFLs). Since the light emitting diodes have advantages like low power consumption, using light emitting diodes to replace the cold cathode fluorescent lamps is the main trend of the development of backlight module industry.

Based on the concept of modular production, backlight modules, no matter direct-type or edge-type, use a light string having a plurality of light emitting diodes connected in series as the light source. Since a backlight module has to provide a stable and uniform surface light source, once one of the light emitting diodes burned out, the broken one needs to be changed immediately so as to maintain the uniformity of the surface light source. Therefore, maintenance or durability of the light strings of the backlight module is restrained by the working life of each of the light emitting diodes.

Hence, it is necessary to provide an LED module and an LED light string using the same to overcome the problems existing in the conventional technology.

SUMMARY OF THE INVENTION

The invention provides an LED module and an LED light string using the same to overcome the problem of lack of durability in a light string of a backlight module.

An LED module comprising: an input terminal, an output terminal, a primary LED, a spare LED and a switching module, wherein the switching module controls the spare LED to be switched off when the primary LED is switched on, and controls the spare LED to be switched on when the primary LED is burned out; and the switching module has a first field-effect transistor, a second field-effect transistor, a first resistor and a second resistor, wherein the source electrode of the first field-effect transistor is connected to the cathode of the primary LED and connected to ground orderly through the first resistor and the second resistor, the drain electrode thereof is connected to the output terminal, and the gate electrode thereof is connected to ground through the second resistor; the source electrode of the second field-effect transistor is connected to the cathode of the spare LED, the drain electrode thereof is connected to the output terminal, and the gate electrode thereof is connected to the gate electrode of the first switch; and the threshold voltage Vth1 of the first field-effect transistor and the threshold voltage Vth2 of the second field-effect transistor satisfy the following condition: $Vth1>-(Vs1-Vf)R1/(R1+R2)>Vth2>-(Vs1-Vf)$, wherein Vs1 is an input voltage received by the input terminal, Vf is the forward voltage drop of the primary LED and the spare LED, R1 is the resistance value of the first resistor, R2 is the resistance value of the second resistor.

An LED module comprising: an input terminal, an output terminal, a primary LED, a spare LED and a switching module, wherein the anode of the primary LED is connected to the input terminal, the cathode thereof is connected to the output terminal through the switching module; the anode of the spare LED is connected to the input terminal, the cathode of the spare LED is connected to the output terminal through the switching module; and the switching module controls the spare LED to be switched off when the primary LED is switched on, and controls the spare LED to be switched on when the primary LED is burned out.

In one embodiment of the present invention, the switching module has a first switch and a second switch, wherein the first switch is connected to the cathode of the primary LED and the output terminal, and the second switch is connected to the cathode of the spare LED and the output terminal, wherein when the primary LED is switched on, the first switch is switched on and the second switch is switched off; when the primary LED is burned out, the first switch is switched off and the second switch is switched on.

In one embodiment of the present invention, the switching module further has a first resistor and a second resistor, wherein the cathode of the primary LED is connected to ground orderly through the first resistor and the second resistor.

In one embodiment of the present invention, the switching module has a first field-effect transistor, a second field-effect transistor, a first resistor and a second resistor, wherein the source electrode of the first field-effect transistor is connected to the cathode of the primary LED and connected to ground orderly through the first resistor and the second resistor, the drain electrode thereof is connected to the output terminal, and the gate electrode thereof is connected to ground through the second resistor; the source electrode of the second field-effect transistor is connected to the cathode of the spare LED, the drain electrode thereof is connected to the output terminal, and the gate electrode thereof is connected to the gate electrode of the first switch.

In one embodiment of the present invention, the first field-effect transistor and the second field-effect transistor are p-channel metal-oxide-semiconductor field-effect transistors.

In one embodiment of the present invention, the threshold voltage Vth1 of the first field-effect transistor and the threshold voltage Vth2 of the second field-effect transistor satisfy the following condition: $Vth1>-(Vs1-Vf)R1/(R1+R2)>Vth2>-(Vs1-Vf)$, wherein Vs1 is an input voltage received by the input terminal, Vf is the forward voltage drop of the primary LED and the spare LED, R1 is the resistance value of the first resistor, R2 is the resistance value of the second resistor.

An LED light string comprising: multiple serial-connected LED module s, wherein each LED module has an input terminal, an output terminal, a primary LED, a spare LED and a switching module, wherein the anode of the primary LED is connected to the input terminal, the cathode thereof is connected to the output terminal through the switching module; the anode of the spare LED is connected to the input terminal, the cathode of the spare LED is connected to the output terminal through the switching module; and the switching module controls the spare LED to be switched off when the primary LED is switched on, and controls the spare LED to be switched on when the primary LED is burned out.

In one embodiment of the present invention, the switching module has a first switch and a second switch, wherein the first switch is connected to the cathode of the primary LED and the output terminal, and the second switch is connected to the cathode of the spare LED and the output terminal, wherein when the primary LED is switched on, the first switch is switched on and the second switch is switched off; when the primary LED is burned out, the first switch is switched off and the second switch is switched on.

In one embodiment of the present invention, the switching module further has a first resistor and a second resistor, wherein the cathode of the primary LED is connected to ground orderly through the first resistor and the second resistor.

In one embodiment of the present invention, the switching module has a first field-effect transistor, a second field-effect transistor, a first resistor and a second resistor, wherein the source electrode of the first field-effect transistor is connected to the cathode of the primary LED and connected to ground orderly through the first resistor and the second resistor, the drain electrode thereof is connected to the output terminal, and the gate electrode thereof is connected to ground through the second resistor; the source electrode of the second field-effect transistor is connected to the cathode of the spare LED, the drain electrode thereof is connected to the output terminal, and the gate electrode thereof is connected to the gate electrode of the first switch.

In one embodiment of the present invention, the first field-effect transistor and the second field-effect transistor are p-channel metal-oxide-semiconductor field-effect transistors.

In one embodiment of the present invention, the LED modules are orderly assigned as L1, L2, . . . Li, . . . ,Ln, wherein $n \geq 2$, and $1 \leq i \leq n$, the threshold voltage Vth1 of the first field-effect transistor and the threshold voltage Vth2 of the second field-effect transistor of each LED module Li satisfy the following condition: $Vth1 > -(Vs1 - i*Vf)R1/(R1+R2) > Vth2 > -(Vs1 - i*Vf)$, wherein Vs1 is an input voltage received by the input terminal, Vf is the forward voltage drop of the primary LED and the spare LED, R1 is the resistance value of the first resistor, R2 is the resistance value of the second resistor, and $Vs1 - (n*Vf) > 0$.

Comparing with the conventional technology, the LED module of the present invention includes a primary LED, a spare LED and a switching module, wherein the switching module controls the spare LED to be switched off while the primary LED is switched on; and controls the spare LED to be switched on while the primary LED is burned out. Therefore, an LED light string using the LED modules can continue to provide a stable light source while one primary LED is burned out, and thereby has better durability.

DETAILED DESCRIPTION OF THE PREFERRED EMBODIMENTS

The foregoing objects, features and advantages adopted by the present invention can be best understood by referring to the following detailed description of the preferred embodiments and the accompanying drawings. Furthermore, the directional terms described in the present invention, such as upper, lower, front, rear, left, right, inner, outer, side and etc., are only directions referring to the accompanying drawings, so that the used directional terms are used to describe and understand the present invention, but the present invention is not limited thereto.

Figure 1:
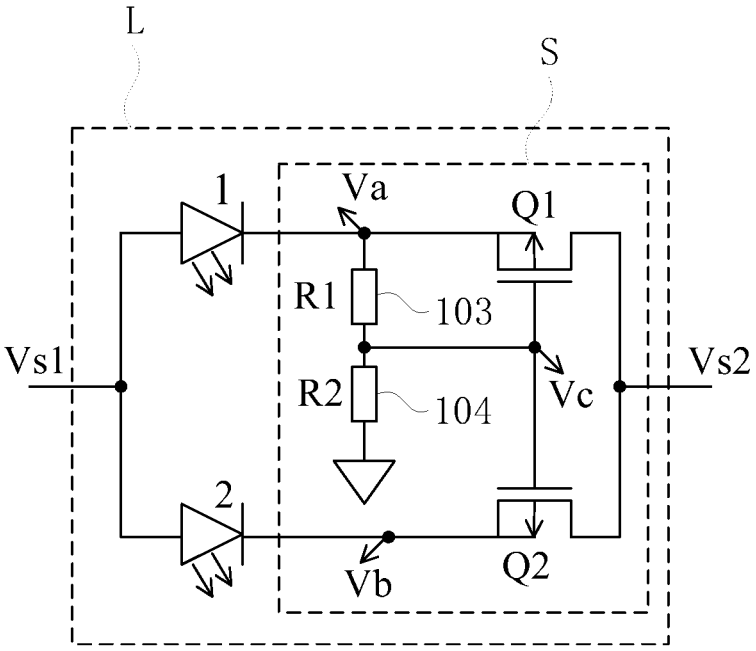
FIG. 1 is a circuit diagram of a preferred embodiment of an LED module in accordance with the present invention.

With reference to FIG. 1, FIG. 1 is a circuit diagram of a preferred embodiment of an LED module in accordance with the present invention. The LED module L has an input terminal (not labeled), an output terminal (not labeled), a primary LED 1, a spare LED 2 and a switching module S. The input terminal receives an input voltage Vs1. The output terminal outputs an output voltage Vs2.

The anode of the primary LED 1 and the anode of the spare LED 2 are both connected to the input terminal. The forward voltage drop of the primary LED 1 and the spare LED 2 is Vf.

The switching module is connected to the cathode of the primary LED 1 and the cathode of the spare LED 2, and controls the spare LED 2 to be switched off when the primary LED 1 is switched on; and controls the spare LED 2 to be switched on and light up when the primary LED 1 is burned out. In detail, the switching module S has a first switch Q1 and a second switch Q2, wherein the first switch Q1 is connected to the cathode of the primary LED 1 and the output terminal. The first switch Q1 is switched on as the primary LED 1 is switched on and lights up. When the primary LED 1 is burned out, the first switch Q1 is switched off due to an open circuit condition. The second switch Q2 is connected to the cathode of the spare LED 2 and the output terminal, and is switched on while the primary LED 1 is burned out and thereby switches on and lights up the spare LED 2.

In this embodiment, the switching module S further has a first resistor R1 and a second resistor R2. The first switch Q1 is a first field-effect transistor, preferably a p-channel metal-oxide-semiconductor field-effect transistor (MOSFET), and has a threshold voltage Vth1, wherein the source electrode of the first switch Q1 is connected to the cathode of the primary LED 1, and also connected to ground orderly through the first resistor 103 and the second resistor 104. The drain electrode of the first switch Q1 is connected to the output terminal. The gate electrode of the first switch Q1 is grounded though the second resistor 104. The second switch Q2 is a second field-effect transistor, preferably a p-channel metal-oxide-semiconductor field-effect transistor (MOSFET), and has a threshold voltage Vth2. The source electrode of the second switch Q2 is connected to the cathode of the spare LED 2. The drain electrode of the second switch Q2 is connected to the output terminal. The gate electrode of the second switch Q2 is connected to the gate electrode of the first switch Q1.

Set the resistance value of the first resistor 103 to be R1 and the resistance of the second resistor 104 to be R2. The threshold voltage Vth1 of the second switch Q1 satisfies: $Vth1 > -(Vs1 - Vf)R1/(R1+R2)$; and the threshold voltage Vth2 of the second switch Q2 satisfies: $-(Vs1 - Vf)R1/(R1+R2) > Vth2 > -(Vs1 - Vf)$. Assume the node voltage on the source electrode of the first switch Q1 is Va; the node voltage on the source electrode of the second switch Q2 is Vb; and the node voltage on the gate electrodes of the first switch Q1 and the second switch Q2 is Vc.

The control method of the LED module L according to this embodiment is described as follows:

When the primary LED 1 is normally working, $Va = Vs1 - Vf$, $Vc = (Vs1 - Vf)R2/(R1+R2)$. A voltage difference between the gate electrode and source electrode of the first switch Q1 is $Vgs1 = Vc - Va$. Therefore, $Vgs1 = -(Vs1 - Vf)R1/(R1+R2)$. Since $Vth1 > -(Vs1 - Vf)R1/(R1+R2)$, therefore $Vgs1 < Vth1$, which satisfies a switched-on condition for the first switch Q1, the first switch Q1 is then switched on.

In the meantime, assume the spare LED 2 is also switched on, then $Vb = Vs1 - Vf$, and the voltage difference between the gate electrode and source electrode of the second switch Q2 is $Vgs2 = Vc - Vb$, therefore, $Vgs2 = -(Vs1 - Vf)R1/(R1+R2)$. Since $Vth2 < -(Vs1 - Vf)R1/(R1+R2)$, therefore $Vgs2 > Vth2$, which does not satisfy a switched-on condition for the second switch Q2, and thereby the assumption fails, and the spare LED 2 should be switched off in the meantime.

When the primary LED 1 is burned out, Vc=0, and Vgs1=0 for the first switch Q1, therefore the first switch Q1 is switched off. In the meantime, assume that the spare LED 2 is switched on and normally works, then Vb=Vs1−Vf and the voltage difference between the gate electrode and source electrode of the second switch Q2 is Vgs2=Vc−Vb=−(Vs1−Vf). Since Vth2>−(Vs1−Vf), we know that Vgs2<Vth2, which satisfies the switched-on condition for the second switch Q2, therefore the spare LED 2 indeed is switched on.

When a plurality of the LED modules L are applied to an LED light string, the control method of the LED light string is executed by the switching module S of each LED module.

Figure 2:
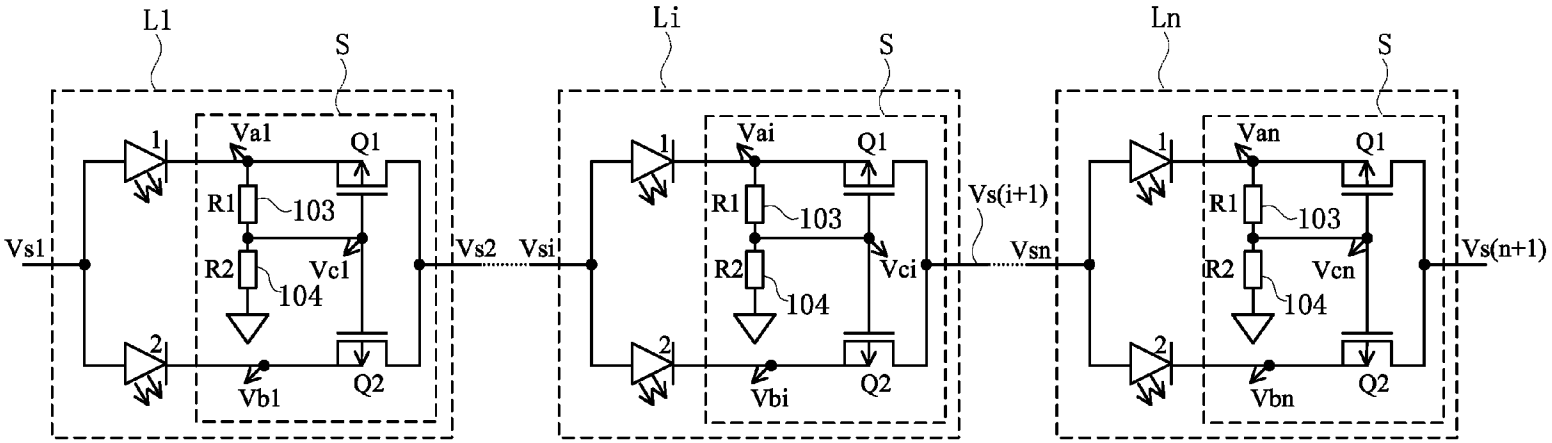
FIG. 2 is a circuit diagram of a preferred embodiment of an LED light string in accordance with the present invention.

With further reference to FIG. 2, FIG. 2 is a circuit diagram of a preferred embodiment of an LED light string in accordance with the present invention. The LED light string has multiple serial-connected LED modules as shown in FIG. 1: L1, . . . ,Li, . . . Ln, wherein n≥2, and 1≤i≤n.

Each LED module L1 includes an input terminal (not labeled), an output terminal (not labeled), a primary LED 1, a spare LED 2 and a switching module S. The input terminal receives an input voltage Vsi. The output terminal outputs a voltage Vs(i+1).

Set the forward voltage drop of the primary LED 1 and the spare LED 2 of each LED module L1 is Vf, and the input voltage received by the first LED module L1 is Vs1. The input voltage of the LED module L1 will be Vsi=Vs1−(i−1)Vf, wherein the input voltage Vs1 of the first LED module L1 satisfies a condition of: Vs1−(n*Vf)>0. Assume that the resistance value of the first resistor 103 of each LED module L1 to be R1, and the resistance of the second resistor 104 of each LED module L1 to be R2.

Set the threshold voltage Vth1 of the first switch Q1 of each LED module Li to satisfy: Vth1>−(Vsi−Vf)R1/(R1+R2)=−(Vs1−i*Vf)R1/(R1+R2). And set the threshold voltage Vth2 of the second switch Q2 of each LED module L1 to satisfy: −(Vs1−i*Vf)=−(Vsi−Vf)<VTh2<−(Vs1−i*Vf)R1/(R1+R2). The node voltage on the source electrode of the first switch Q1 is Vai; the node voltage on the source electrode of the seconde switch Q2 is Vbi; and the gate electrodes of the first switch Q1 and the second switch Q2 is Vci.

The control method of the LED light string is described as follows:

For each LED module L1, when the primary LED 1 is normally working, Vai=Vsi−Vf, and Vci=(Vsi−Vf)R2/(R1+R2). The voltage difference between the gate electrode and the source electrode of the first switch Q1 is Vgs1=Vci−Vai=−(Vsi−Vf)R1/(R1+R2). Since Vth1>−(Vsi−Vf)R1/(R1+R2), therefore Vgs1<Vth1, which satisfies a switched-on condition for the first switch Q1, thereby the first switch Q1 is switched on.

In the meantime, assume that the spare LED 2 is also switched on, thereby Vbi=Vsi−Vf. The voltage difference between the gate electrode and the source electrode of the second switch Q2 is Vgs2=Vci−Vbi. Therefore, Vgs2=−(Vsi−Vf)R1/(R1+R2)=−(Vs1−i*Vf)R1/(R1+R2).

Since Vth2<−(Vsi−Vf)R1/(R1+R2), therefore Vgs2>Vth2, which does not satisfy a switched-on condition for the second switch Q2, thereby the assumption fails and the spare LED 2 in the meantime is switched off.

When the primary LED 1 is burned out, Vci=0, and Vgs1=0 for the first switch Q1, therefore the first switch Q1 is switched off. In the meantime, assume that the spare LED 2 is switched on and normally works, then Vbi=Vsi−Vf and the voltage difference between the gate electrode and source electrode of the second switch Q2 is: Vgs2=Vci−Vbi=−(Vsi−Vf). From Vth2>−(Vsi−Vf), we know that Vgs2<Vth2, which satisfies the switched-on condition for the second switch Q2, therefore the spare LED 2 indeed is in a switched-on status.

Comparing with the conventional technology, the LED module L1 of the LED light string of the present invention includes a primary LED 1, a spare LED 2 and a switching module S. When the primary LED 1 is normally working, the switching module S controls the spare LED 2 to be switched off; when the primary LED 2 is burned out, the switching module S then controls the spare LED 2 to be switched on. Therefore, the LED light string using the LED modules can continue to provide a stable light source while one primary LED is burned out, and thereby has better durability and relatively reduces repair frequency and cost.

The present invention has been described with a preferred embodiment thereof and it is understood that many changes and modifications to the described embodiment can be carried out without departing from the scope and the spirit of the invention that is intended to be limited only by the appended claims.

The invention claimed is:

1. An LED module, characterized in that: the LED module comprising:

an input terminal;

an output terminal;

a primary LED;

a spare LED; and a switching module, wherein the switching module controls the spare LED to be switched off when the primary LED is switched on, and controls the spare LED to be switched on when the primary LED is burned out; and the switching module has a first field-effect transistor, a second field-effect transistor, a first resistor and a second resistor, wherein the source electrode of the first field-effect transistor is connected to the cathode of the primary LED and connected to ground orderly through the first resistor and the second resistor, the drain electrode thereof is connected to the output terminal, and the gate electrode thereof is connected to ground through the second resistor;

the source electrode of the second field-effect transistor is connected to the cathode of the spare LED, the drain electrode thereof is connected to the output terminal, and the gate electrode thereof is connected to the gate electrode of the first field-effect transistor; and the threshold voltage Vth1 of the first field-effect transistor and the threshold voltage Vth2 of the second field-effect transistor satisfy the following condition: Vth1>−(Vs1−Vf)R1/(R1+R2)>Vth2>−(Vs1 −Vf), wherein Vs1 is an input voltage received by the input terminal, Vf is the forward voltage drop of the primary LED and the spare LED, R1 is the resistance value of the first resistor, R2 is the resistance value of the second resistor.

2. An LED module comprising:

an input terminal;

an output terminal;

a primary LED, wherein the anode of the primary LED is connected to the input terminal;

a spare LED, wherein the anode of the spare LED is connected to the input terminal; and a switching module, wherein the cathode of the primary LED is connected to the output terminal through the switching module; the cathode of the spare LED is connected to the output terminal through the switching module; and the switching module controls the spare LED to be switched off when the primary LED is switched on, and controls the spare LED to be switched on when the primary LED is burned out; and the switching module further has a first resistor and a second resistor, wherein the cathode of the primary LED is connected to ground orderly through the first resistor and the second resistor.

3. The LED module as claimed in claim 2, wherein the switching module has a first switch and a second switch;

the first switch is connected to the cathode of the primary LED and the output terminal; and the second switch is connected to the cathode of the spare LED and the output terminal, wherein when the primary LED is switched on, the first switch is switched on and the second switch is switched off; when the primary LED is burned out, the first switch is switched off and the second switch is switched on.

4. The LED module as claimed in claim 2, wherein the switching module has a first field-effect transistor and a second field-effect transistor;

the source electrode of the first field-effect transistor is connected to the cathode of the primary LED and connected to ground orderly through the first resistor and the second resistor, the drain electrode thereof is connected to the output terminal, and the gate electrode thereof is connected to ground through the second resistor; and the source electrode of the second field-effect transistor is connected to the cathode of the spare LED, the drain electrode thereof is connected to the output terminal, and the gate electrode thereof is connected to the gate electrode of the first field-effect transistor.

5. The LED module as claimed in claim 4, wherein the first field-effect transistor and the second field-effect transistor are p-channel metal-oxide-semiconductor field-effect transistors.

6. The LED module as claimed in claim 5, wherein the threshold voltage Vth1 of the first field-effect transistor and the threshold voltage Vth2 of the second field-effect transistor satisfy the following condition: $Vth1>-(Vs1-Vf)R1/(R1+R2)>Vth2>-(Vs1-Vf)$, wherein Vs1 is an input voltage received by the input terminal, Vf is the forward voltage drop of the primary LED and the spare LED, R1 is the resistance value of the first resistor, R2 is the resistance value of the second resistor.

7. An LED light string comprising: multiple serial-connected LED modules, wherein each LED module has:

an input terminal;

an output terminal;

a primary LED, wherein the anode of the primary LED is connected to the input terminal;

a spare LED, wherein the anode of the spare LED is connected to the input terminal; and a switching module, wherein the cathode of the primary LED is connected to the output terminal through the switching module; the cathode of the spare LED is connected to the output terminal through the switching module; and the switching module controls the spare LED to be switched off when the primary LED is switched on, and controls the spare LED to be switched on when the primary LED is burned out; and the switching module further has a first resistor and a second resistor, wherein the cathode of the primary LED is connected to ground orderly through the first resistor and the second resistor.

8. The LED light string as claimed in claim 7, wherein, the switching module has a first switch and a second switch;

the first switch is connected to the cathode of the primary LED and the output terminal; and the second switch is connected to the cathode of the spare LED and the output terminal, wherein when the primary LED is switched on, the first switch is switched on and the second switch is switched off; when the primary LED is burned out, the first switch is switched off and the second switch is switched on.

9. The LED light string as claimed in claim 7, wherein the switching module has a first field-effect transistor and a second field-effect transistor:

the source electrode of the first field-effect transistor is connected to the cathode of the primary LED and connected to ground orderly through the first resistor and the second resistor, the drain electrode thereof is connected to the output terminal, and the gate electrode thereof is connected to ground through the second resistor; and the source electrode of the second field-effect transistor is connected to the cathode of the spare LED, the drain electrode thereof is connected to the output terminal, and the gate electrode thereof is connected to the gate electrode of the first field-effect transistor.

10. The LED light string as claimed in claim 9, wherein the first field-effect transistor and the second field-effect transistor are p-channel metal-oxide-semiconductor field-effect transistors.

11. The LED light string as claimed in claim 10, wherein the LED modules are orderly assigned as L1, L2,. . .,Li,. . .,Ln, wherein $n>2$, and $1\leq i\leq n$, the threshold voltage Vth1 of the first field-effect transistor and the threshold voltage Vth2 of the second field-effect transistor of each LED module Li satisfy the following condition: $Vth1>-(Vs1-i*Vf)R1/(R1+R2)>VTh2>-(Vs1-i*Vf)$, wherein Vs1 is an input voltage received by the input terminal, Vf is the forward voltage drop of the primary LED and the spare LED, R1 is the resistance value of the first resistor, R2 is the resistance value of the second resistor, and $Vs1-(n*Vf)>0$.

* * * * *